United States Patent [19]

Theis, Jr. et al.

[11] 4,076,449

[45] Feb. 28, 1978

[54] PRESSURE GAS ENGINE

[75] Inventors: James V. Theis, Jr., Delray Beach; Lynn M. Davis, Boca Raton; Donald H. Moss, Delray Beach, all of Fla.

[73] Assignee: Hollymatic Corporation, Park Forest, Ill.

[21] Appl. No.: 694,894

[22] Filed: Jun. 10, 1976

[51] Int. Cl.[2] ..... F03B 15/18

[52] U.S. Cl. ..... 415/18; 415/25; 415/36; 173/12; 192/105 B; 188/187

[58] Field of Search ..... 415/18, 25, 36; 173/12; 188/187; 192/105 B

[56] References Cited

U.S. PATENT DOCUMENTS

| | | | |
|---|---|---|---|
| 1,167,018 | 1/1916 | Pyle | 415/18 |
| 2,362,676 | 11/1944 | Stechbart | 188/187 |
| 2,865,475 | 12/1958 | MacMillin | 188/187 |
| 3,265,172 | 8/1966 | Atsumi et al. | 192/105 B |
| 3,442,362 | 5/1969 | Bangerter | 173/12 |
| 3,844,387 | 10/1974 | Morokoshi | 188/187 |

*Primary Examiner*—C. J. Husar

*Attorney, Agent, or Firm*—Wegner, Stellman, McCord, Wiles & Wood

[57] ABSTRACT

A pressure gas engine such as a compressed air turbine having a variable speed device for controlling the speed of a rotor and also having an overspeed safety device to prevent damage to the engine in the case of excess speed through malfunction. The overspeed safety device includes speed responsive elements that force the rotor against braking elements that are successively operated to brake the rotor to a complete stop in successive gentle braking actions and with the speed responsive elements including means for preventing resumed rotation of the rotor until the engine has been partially dismantled and the cause of the malfunction corrected.

5 Claims, 11 Drawing Figures

PRESSURE GAS ENGINE

CROSS REFERENCE TO RELATED APPLICATIONS

Certain inventions disclosed herein are claimed in copending applications assigned to the assignee hereof with these applications being:

Theis et al. Ser. No. 694,892, filed June 10, 1976 and Aldo Ceresa Ser. No. 694,893, filed June 10, 1976.

BACKGROUND OF THE INVENTION

This invention relates to a pressure gas engine having a safety overspeed device to prevent damage to the engine in which the engine comprises a rotor operated by the gas with means for moving the rotor out of cooperation with the pressure gas and means for braking the rotor to a stop together with means for causing the pressure gas itself to move the rotor into contact with the brake means and to hold it there.

DESCRIPTION OF THE PREFERRED EMBODIMENT

Figure 1:
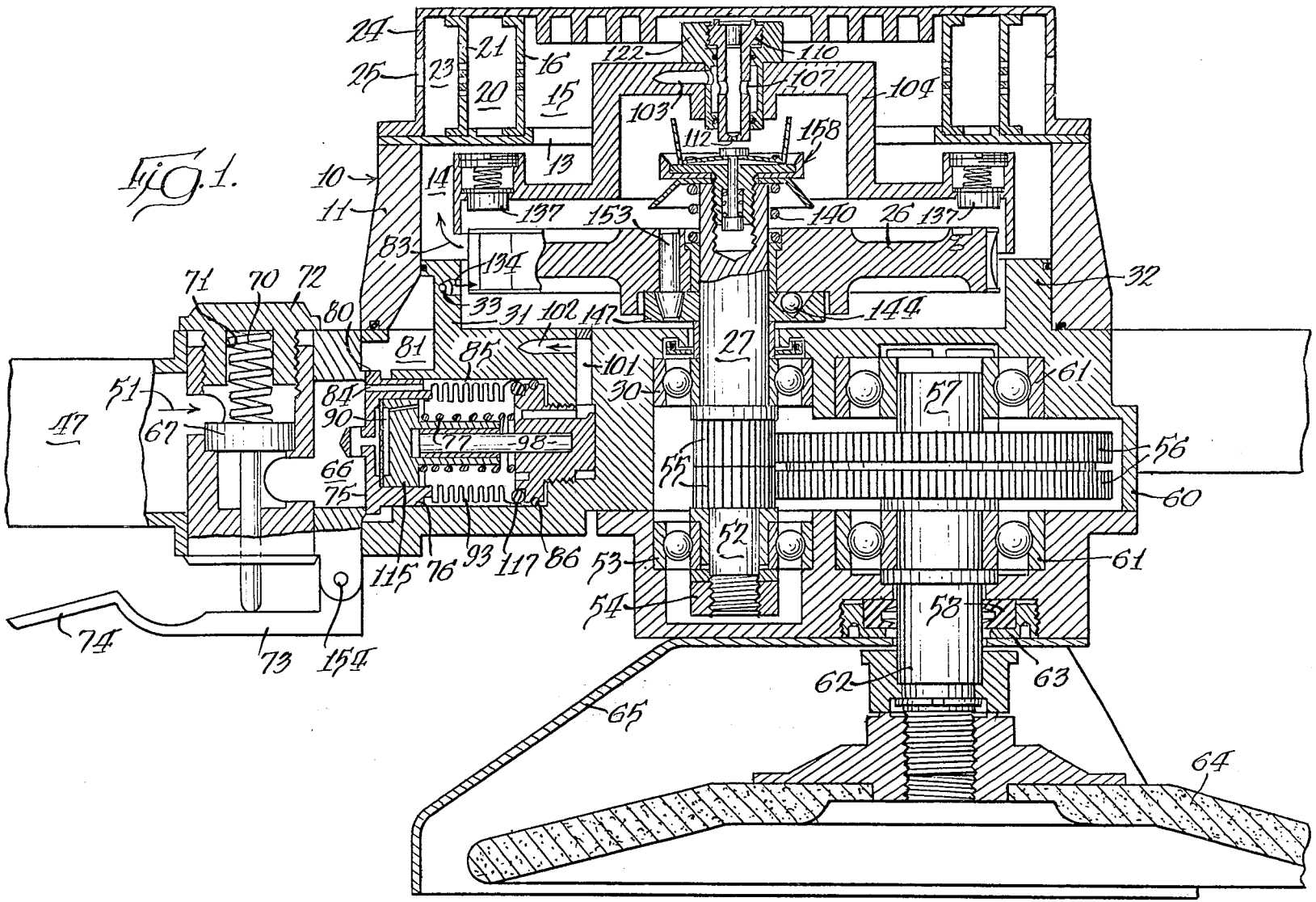
FIG. 1 is a fragmentary sectional view through a grinder operated by compressed air and embodying the invention.

The pressure gas engine 10 of the embodiment illustrated has a casing 11 including a portion 12 in which are located vent openings 13 that communicate between an exhaust chamber 14 of large cross sectional dimensions for essentially unrestricted gas flow and an auxiliary chamber 15 defined by a peripheral wall 16 containing gas flow openings 17 leading to a space 20 defined on the outer side by a wall 21 similar to the wall 16 and also containing gas flow openings 22. These openings lead to a further chamber 23 defined by an outermost wall 24 in which are located in circular series large exhaust openings 25 to the atmosphere.

Figures 2, 3:
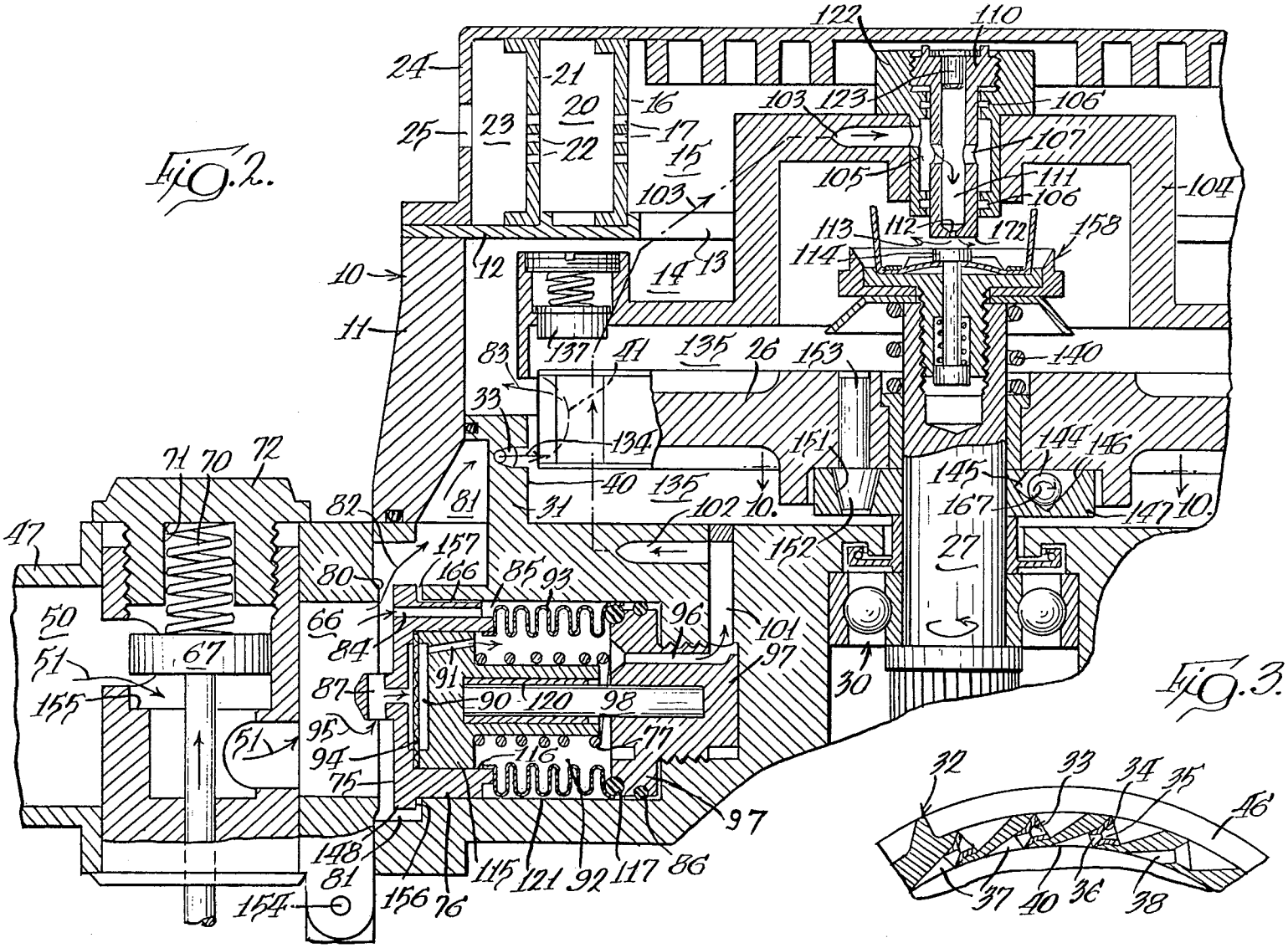
FIG. 2 is a somewhat larger view similar to FIG. 1 and showing the speed control portions in a different position.
FIG. 3 is a fragmentary sectional view through the wall 31 which functions as a nozzle mounting.

The engine 10 includes an interior rotor 26 mounted for rotation with an axle 27 that is supported on spaced ball bearing structures 30 and 53. The rotor 26 is surrounded by a wall 31 that operates as a stator nozzle plate 32 and contains an arcuate series of converging-diverging nozzles 33 each having (FIG. 3) a converging entrance 34, a throat 35 and a diverging exhaust end 36 for creating sonic or supersonic gas flow 134 through the nozzles. As shown in FIG. 3 each nozzle 33 is located in an opening 38 that is aligned on the chord of the circle defining the inner periphery 40 of the plate 32.

Figure 4:
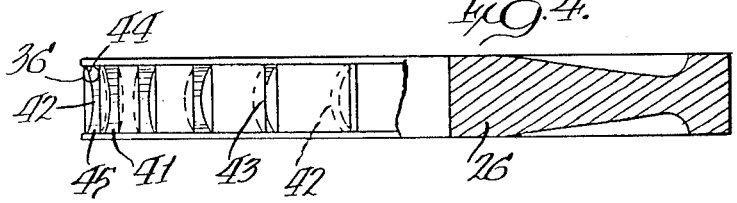
FIG. 4 is a fragmentary side elevational view of a portion of the rotor of this invention partially broken away and partially in section.

As shown in FIG. 4 the rotor 26 contains a peripheral series of outwardly opening buckets 41 that have arcuate impulse surfaces 42 extending substantially between the opposite sides 28 and 29 of the rotor 26. Each adjacent pair of buckets is separated by a knife edge 43 so that the high velocity gas will be divided by the knife edges without substantial restraint into the buckets as the buckets pass each nozzle. The relationship of the exhaust end 36 of each nozzle to the bucket surface 42 is shown at the top of FIG. 4.

As is shown there, the nozzle exhaust enters the bucket at one side 44 thereof and then sweeps around in a smooth unobstructed arc to exhaust at the opposite side 45. This provides a smooth wiping action on the impulse surfaces 42 that converts pressure energy of the sonic or supersonic gas flow to rotational energy of the rotor. Thus the nozzles 33 comprise first energy conversion means for converting gas pressure to gas velocity while the series of buckets 41 comprise second energy conversion means for converting gas velocity to power.

The stator plate 32 containing the nozzles 33 also includes a peripheral portion 46 for directing the gas flow into the nozzles in the fixed stator plate 32.

The casing 11 has extending therefrom a tube 47 that is hollow as shown at 50 to serve as a handle and a conduit for pressurized gas flow 51 which can conveniently be compressed air.

The one end 52 of the axle 27 if provided with a second ball bearing structure 53 similar to the first structure 30. Opposite this end 52 of the axle 27 is a positioning lock nut 54.

Mounted on the axle 27 between the bearings 30 and 53 is a small circular gear 55 which meshes with a large circular gear 56 mounted on, for rotation with, a stub shaft 57 so that the combination is rotatable within the casing portion 60 on a pair of spaced ball bearing structures 61. The shaft 57 is provided with a projecting end portion 62 that is sealed to the casing portion by a seal plate 63 and gasket 58. This end 62 of the shaft 57 has mounted thereon in the illustrated embodiment a grinding disc 64 that is partially enclosed in the customary manner by a guard 65 mounted on the end of the casing portion 60 through which the shaft 62 extends.

Leading from the hollow chamber 50 in the conduit and handle 47 for flow 51 of the pressurized gas such as compressed air is a passage 66 that is normally closed by a valve piston 67 usually held in closed position by a compression spring 70. This spring is retained in a chamber 71 in a threaded closure 72. The piston 67 may be moved from its normally closed position as shown in FIG. 1 to an open position as shown in FIG. 2 by a hinged lever 73 including a handle portion 74.

Gas in the passage or chamber 66 presses against the end 75 of a slidable piston 76. This piston 76 is normally urged to its closed position which is the extreme left position in the illustrated embodiment of FIG. 1 by a helical compression spring 77 (FIG. 2). This spring together with gas pressure in a manner to be explained hereinafter holds the piston 76 in the left or closed position of FIG. 1 until the forces in the chamber 66 acting on the end 75 are sufficient to move the piston as to the partially open or right position of FIG. 2. The piston end 75 operates as a gas valve blocking flow of gas from the chamber 66 when the end 75 bears against an annular valve seat 80 as shown in FIG. 1.

Surrounding the valve seat 80 and the corresponding annular valve edge portion of the end 75 is a second gas chamber 81. When compressed air, for example, is admitted to this chamber 81 from chamber 66 by the open piston valve 76, as illustrated by the air flow arrow 82, this air immediately is free to flow through the series of nozzles 33 (of which only one is shown in FIGS. 1 and 2) to sweep through the impeller buckets 41, as indicated by the arrow 83, to impart rotational forces to the rotor 26 and thereby to the axle 27 to rotate the grinding disc 64 by way of the gears 55 and 56 and the stub shaft 62.

The exhaust gas 83 from the buckets passes unhindered from the exhaust sides 45 (FIG. 4) of the buckets directly into the relatively large chamber 14 in a direction that is generally radial to the rotor 26 as shown at 83 in FIG. 2 and from there through the openings 13, chamber 15, openings 17, chamber 20, openings 22, chamber 23 and openings 25 into the ambient atmosphere.

The piston 76, its end surface 75 and the annular valve seat 80 are all parts of the governor system for controllling the speed of rotation. This speed control is accomplished by metering the incoming gas between the end surface 75 and the valve seat 80 by increasing and decreasing the pressure of the gas in the piston area.

In order to minimize the change in force exerted on the bellows 93 by the variation in gas pressure surrounding the outside of the bellows, the bellows is surrounded by a chamber 85 which is pressurized by gas bled through a passage 84 from the main gas supply chamber 66. Chamber 66 has much less pressure variation than chamber 81 during normal governed turbine operation. An O-ring gasket 86 seals one end of the chamber 85 from outside pressure effects.

The piston 76 at the end adjacent to the valve seat 80 is provided with a gas passage 87 tht extends inwardly through a small chamber 90 and an inner passage 91 to an interior chamber 92 within the extensible bellows 93. The chamber 90 is provided with a filter 94 for intercepting foreign material carried by the incoming gas whose flow is indicated by the arrow 95. The interior 92 of the bellows 93 communicates with a passageway 96 in a guide pin retainer 97 which retains an axial guide pin 98 that is slidably attached to the guide post 115 for guiding the longitudinal movement thereof. The passageway 96 communicates with a passageway 101 which joins with a continuous passageway 102 and 103 (indicated by the broken line in FIG. 2) to a trigger adjuster insert 122 and into chamber 105 which is sealed at each end by sealing gasket O-rings 106.

The chamber 105 is provided with exit openings 107 that lead through the trigger adjuster screw 110 and into the internal chamber 111. From this chamber 111 the gas exits by way of a small axial passage 112 as indicated by the flow arrows 113. Flow through this passage 112 is metered by the movable trigger pin 114.

A guide post 115 at the piston 76 is press fitted into the piston at the end 75 thereby holding the filter 90 in position. The bellows 93 is attached in gas tight relationship to the movable piston 76 in an annular section 116 into which the guide post 115 is press fitted. A larger O-ring 117 is provided at the fixed retainer 97 adjacent to the end O-ring 86 (that seals the retainer 97 and housing 11) to form a gas tight seal at this fixed end of the bellows 93 and thereby seal the interior 92 of the bellows from the exterior chamber 85.

The guide pin 98 is provided with a bushing 120 that provides a bearing surface for a slip fit to the guide pin 98 thereby preventing the assembly of guide post 115 and annular section 166 of piston end 75 from angling and jamming against the cylinder wall portion 121 of the casing 11.

At the opposite end of the air flow passageways 96 and 101–103 the trigger adjuster insert 122 provides a convenient mounting for the trigger adjuster screw 110. This adjuster insert 122 is press fitted into the housing 104 and an outer closure plug 123 is press fitted into screw 110 to provide a closure to the internal chamber 111.

The speed governor trigger structure is illustrated in FIGS. 1 and 2 in association with the rest of the embodiment and in FIGS. 5–8 in enlarged detail.

This trigger mechanism comprises a main body 124 that is attached to the rotor axle 27 by means of screw threads 125 that engage a similarly shaped axle recess in the end of the drive shaft 27. A backing ring 126 forms a part of the body 124 and this ring provides a support for a leaf spring 127 that has diametrically opposite upstanding arms 130 that are centrifugally responsive for movement outwardly away from each other. At increasing speeds of rotation 131 the arms 130 flex outwardly under increasing centrifugal forces as indicated by the arrows 132 and at maximum desired outward movement corresponding to highest governed speed these arms 130 contact and are supported by an inclined annular surface 133 located on the interior of the backing ring 126 to prevent accidental damage to the arms at extremely high speed such as those resulting from the misadjustment or failure of the governor. Since the limitation of outward movement of the arms 130 by the annular surface 133 also limits the motion of trigger pin 114 toward surface 172, contact between pin 114 and the surface 172 of the trigger adjuster screw 110 can be prevented if desired.

As explained earlier, the trigger pin 114 serves as a metering device to meter and control the gas flow 113 from the chamber 111 through the metering orifice or passage 112.

Figure 9:
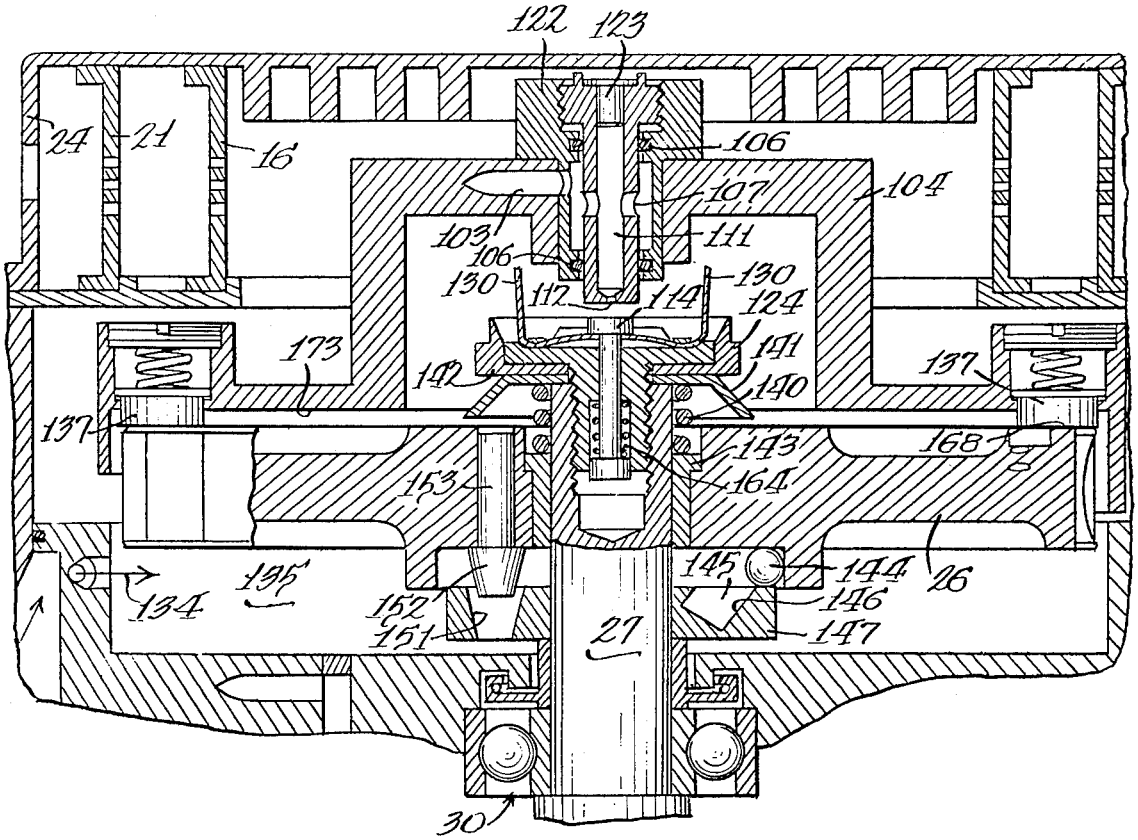
FIG. 9 is a fragmentary sectional view similar to a portion of FIG. 2 but illustrating the rotor 26 in braked position in contact with the friction pad 137.
Figure 10:
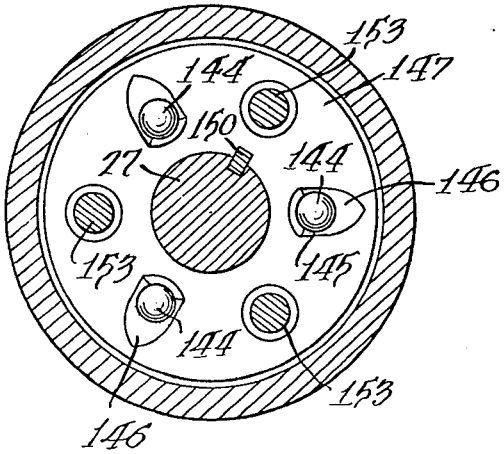
FIG. 10 is a sectional view taken substantially along line 10—10 of FIG. 2.
Figure 11:
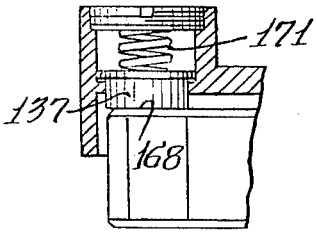
FIG. 11 is an enlarged detail sectional view of a portion of FIGS. 1, 2 and 9.

The pressure gas engine 10 embodied in the illustrated air turbine includes an overspeed safety device that is illustrated most clearly in FIGS. 2, 9 and 10. This device provides a positive braking action in the event of a governor failure tending to produce excessive speeds. Where the engine is used to power an abrasive wheel, for example, such a safety device is of very great importance as excessive centrifugal forces can of course cause a violent disintegration of the grinding wheel. In addition, the device of this invention also prevents the engine from commencing rotation after it has been stopped by the safety device until the engine has been disassembled and reactivated as when making repairs.

As is shown in FIGS. 1 and 2 the rotor 26 having a series of buckets as shown in FIG. 4 normally is rotated by pressurized gas indicated by the arrow 134 entering the buckets in the rotating rotor 26 from the nozzles 33 as previously described. The rotor is located in a chamber 135 that is considerably wider in vertical direction as shown in FIGS. 1, 2 and 3 than is the thickness of the rotor 26 itself. The rotor 26 is longitudinally slidable on the axle 27 between the normal operating position of FIGS. 1 and 2 and the non-operating or raised position as illustrated in FIG. 9. When in the raised position a peripheral side surface 168 of the rotor 26 comes in contact with friction pads 137 (or a single pad if desired) which may be of any material exerting a friction braking action on the side surface 136 and thus may be leather, asbestos or any desired material.

If less than the maximum braking effect is desired, the normal force between the friction pads 137 and surface 168 of the rotor 26 must be limited. For this purpose surrounding the end of the axle 27 that is adjacent to the trigger body 124 previously described is a helical compression spring 140 the outer end of which bears against an inverted dish-shaped mechanical stop 141 that abuts against the trigger body base 142 and the other end of which bears against a shoulder 143. The stop 141 is provided so that as the rotor 26 moves from the operating position of FIGS. 1 and 2 to the braked position of FIG. 9 the rotor contacts the stop 141 after contacting the yielding spring loaded pads 137 but before contacting the surface 173 of chamber 135. In this way the spring loaded pads apply a controlled braking force to the rotor 26.

The operating portion of the overspeed safety device comprises a plurality of steel balls 144, here shown as three, each located in a recess 145 each having an upwardly and outwardly inclined outer surface 146. During normal rotation the balls 144 are located deep within their recesses as shown in FIG. 2 allowing proper rotor-to-nozzle alignment so that the pressurized gas 134 from the nozzles 33 sweeps the buckets, as previously described, and rotates the rotor 26 and the parts attached thereto. The recesses 145 in which are located the balls 144 are formed in one side of a ring 147 that is attached to the drive axle 27. This ring is keyed to the shaft 27 by a key lock 150 as illustrated in FIG. 10. The ring 147 also includes tapered openings 151 of a generally frustoconical shape with the taper widening toward the rotor 26. In the embodiment illustrated there are three of these openings 151 each receiving a similarly tapered end 152 of a pin 153.

OPERATION

When the engine or turbine 10 is at rest as shown in FIG. 1 the main control valve piston 76 is in closed position with the surface 75 held against the annular valve seat 80 by the spring 77. Then, to operate, the lever 73 is moved about its fulcrum 154 as to the position shown in FIG. 2 which raises the control valve piston 67 away from its seat 155 thereby admitting compressed air or other pressurized gas flow 51 into the piston chamber 66 in a volume flow tht is dependent on the positioning of the lever 73 and thus the position of the valve 67.

Air from the chamber 66 is bled into the interior chamber 92 in the bellows 93 through the series of bleed lines 87, 90 and 91. This air then flows out through passages 96, 101, 102, 103, 105, 107 and 111, through orifice 112 past wide open valve 114 to atmosphere. Since exit orifice 112 is much larger than air entrance orifice 91, only a relatively low pressure is maintained in bellows chamber 92. At the same time, air from chamber 66 flows through the bleed line 84 to the chamber 85 surrounding the bellows 93. Since the passage 84 is much larger in cross section area than a cylindrical gap 166 that exists between the piston 76 and the cylinder wall 121, the pressure in the chamber 85 is nearly equal to that in chamber 66. The air pressure in chamber 66 exerts a force on the exposed surface 75 of valve 76. This surface 75 is made large enough for air pressure acting on it from chamber 66 to overcome the total combined forces on its opposite side generated by the helical spring 77 and air pressure in chambers 92 and 85. Therefore, the opening of valve piston 67 to introduce air pressure into the chamber 66 immediately causes this pressure acting on the surface 75 to open the control valve 76 as described.

As can be seen in FIGS. 1 and 2, the extent of movement of the valve 76 is limited between the fully closed position of FIG. 1 where the surface 75 bears against the annular valve seat 80 and the fully open position in which an annular surface 156 on the piston bears against an annular stopping surface 157. As can be seen in FIG. 2, the surfaces 75 and 156 of the control valve piston 76 are on opposite sides of an annular flange 148.

When the control valve piston 76 is either partially or completely open, the air for example flows into the surrounding chamber 81 as illustrated by the arrow 82 in FIG. 2. This air then flows through the converging-diverging nozzles 33 in the annular wall 31 which functions as a stator plate or nozzle plate 32. This air 134 from the nozzles 33 wipes across the surfaces 42 of the buckets 41 thereby causing rotation in the rotor 26.

This type of sonic or supersonic nozzle and bucket arrangement is disclosed and claimed generically in prior U.S. Pat. No. 3,930,744 also assigned to the same assignee.

The air exiting from the buckets 41 during rotation of the rotor 26 then enters the large chamber 14 under low back pressure. From there the air flows through the large openings 13 into the correspondingly large chamber 15 and from there to ambient through the successive plurality of holes 17, 22 and 25.

In order to maintain the speed of the turbine 10 the flow of air 82 to the nozzles 33 striking the turbine bucket surfaces 42 must be varied so that the torque applied to the turbine rotor 26 will substantially balance the opposite load torque exerted on the rotor shaft 27 through the gears 55 and 56 by varying external loads applied to the shaft 62. This is done by moving the piston 76 (the surface 75) relative to the valve seat 80. The movement of piston 76 is caused by changes of the gas pressure in chamber 92. For example, as the pressure in chamber 92 decreases, the force of air pressure acting on the surface 75 of the piston 76 overcomes the forces acting on the bellows side of the piston 76 causing the surface 75 to move away from the seat 80 allowing more air 82 from passage 66 to flow through nozzles 33. This increases the torque developed by the turbine 26 on the shaft 27. Conversely, if the pressure in chamber 92 increases, the valve 76 closes reducing the air flow 82 to the nozzles 33 and consequently the turbine torque. The governing of the turbine torque is controlled by the speed sensitive bleed control valve 112.

This valve 112 varies the back pressure in the bellows chamber 92 and thus changes the turbine torque to match the load torque allowing the turbine to reach quickly a predetermined no load speed. The valve 112 also decreases the back pressure in the bellows chamber 92 as the speed of the turbine drops due to increased loads. The decrease in the bellows chamber pressure allows greater torque to be developed by the turbine 26 to counterbalance the increased load torque. This prevents excessive speed drop and efficiency losses of the turbine motor.

To allow the speed sensitive bleed control valve 112 to vary the back pressure in the bellows chamber 92, there is provided a passage 91 of piston 76 to allow a metered flow of air 84 to pass into bellows chamber 92 and from there flow through passages 96, 101, 102, 103, annular chamber 105, central chamber 111, through the series of openings 107 to the axial orifice passage 112 opposite the speed control valve piston 114 of the speed responsive device 158.

Figure 5:
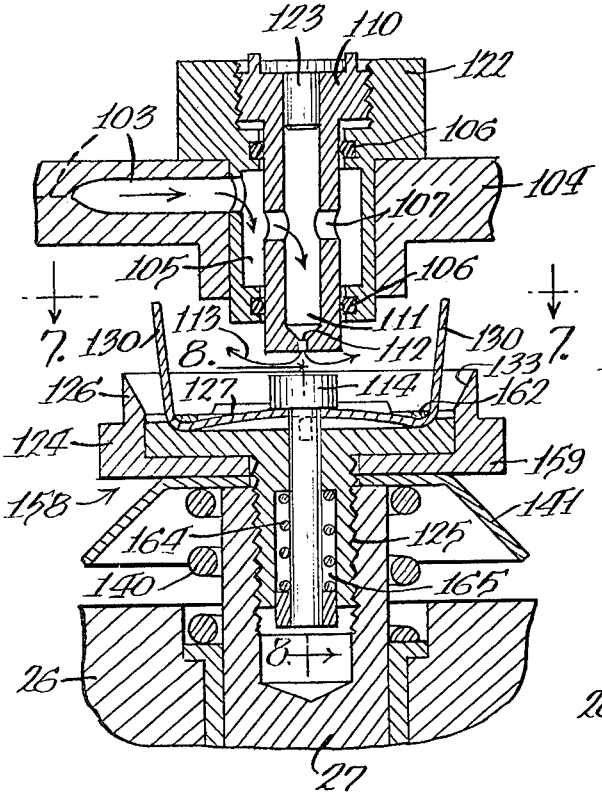
FIG. 5 is an enlarged sectional view illustrating a portion of the engine of the invention.
Figure 6:
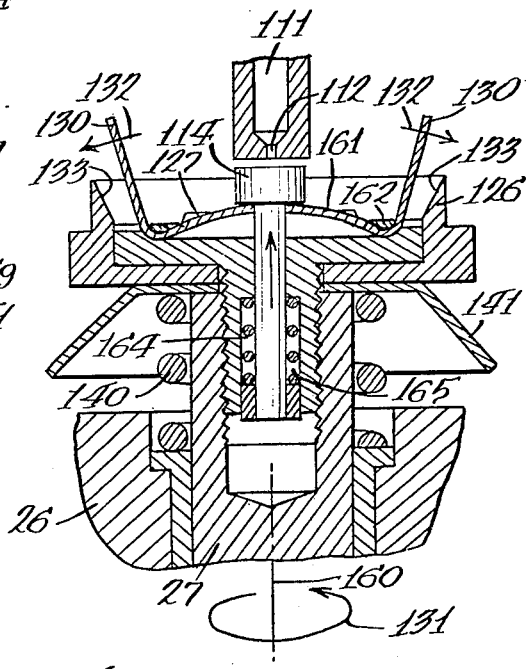
FIG. 6 is a view similar to a portion of FIG. 5 but illustrating the operating parts at a higher speed position.
Figure 7:
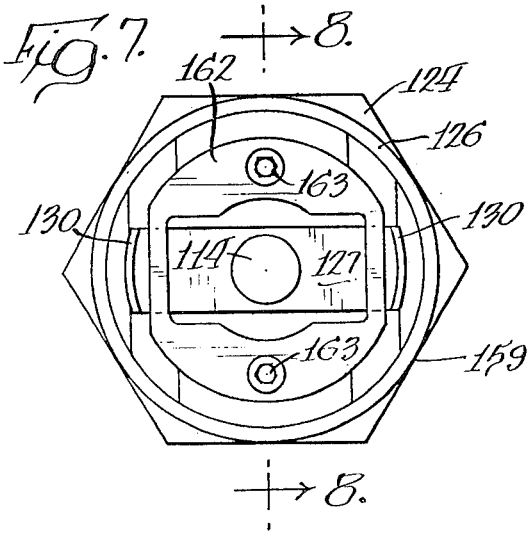
FIG. 7 is a plan view of a portion of the speed responsive device of FIG. 5 looking generally from line 7—7 of FIG. 5.
Figure 8:
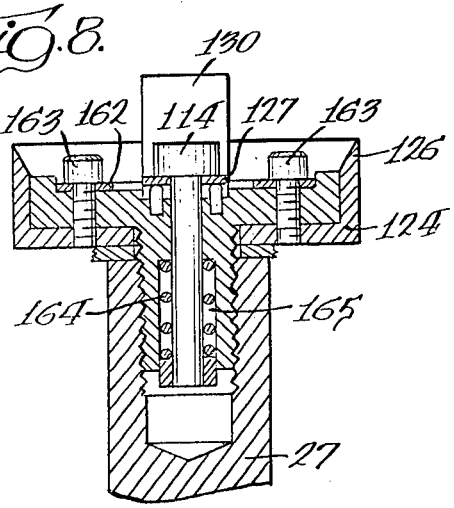
FIG. 8 is a fragmentary sectional view taken substantially along line 8—8 of FIG. 5.

As shown in greater detail in FIGS. 5-8, this speed responsive device 158 comprises a trigger body 124 that is mounted on the end of the drive shaft or axle 27 on which the rotor 26 is mounted so that the two rotate as a unit under the force developed in the nozzle and bucket combination as described. This trigger body 124 in general comprises a hexagonal plate 159 from which projects the annular backing ring 126. This trigger body 124 has mounted on it the flat spring 127 having projecting arms 130 arranged substantially parallel to the axis of rotation 160. The spring 127 (of which the centrifugally responsive arms 130 are a part) is mounted on a circular insert 162 within a recess in the trigger body 124 by a pair of screws 163. Actually, in the illustrated embodiment, these arms 130 are not exactly parallel but are bowed outwardly to a small extent. These arms when subjected to the centrifugal forces of rotation 131 tend to move outwardly as shown at FIG. 6 by the arm movement arrows 132.

The spring arms 130 are always returned to their normal position shown in FIG. 5 when the turbine stops. Simultaneously a helical spring 164 retained in a recess 165 returns the piston 114. The outward movement of the arms under increasing speeds of rotation bows the central portion 161 of the centrifugally responsive spring 127 to move the trigger pin 114 closer to the axial bleed orifice passage 112 as can be seen by a comparison of FIGS. 5 and 6. This partially blocks the orifice and reduces the flow of the bleed air 113 thereby increasing the pressure in the chamber 92. This increase in back pressure moves the piston 76 closer to the seat 80 reducing the torque of the turbine 26 as previously described until equilibrium of the turbine torque and load torque results in a constant steady speed.

An increase in the load torque will result in a corresponding loss in turbine speed. This speed drop reduces the centrifugal force 132 acting on the arms 130 of the speed responsive device 158. This drop in force 132 on the arms 130 allows the arms to move together reducing the amount of bow in the central portion 161 of the centrifugally responsive spring 127 and allows the helical spring 164 to withdraw the trigger pin 114 to a position further from the orifice 112. This movement of the pin 114 reduces the restriction of the bleed air 113 flowing from the orifice 112. The resulting increased flow of bleed air from the bellows chamber 92 causes the pressure in the chamber 92 to decrease. As previously described, this allows more air to flow to the turbine 26 thereby increasing the turbine torque.

These changes continue until once again the torque developed by the turbine is substantially equal to the combined load torques. Once this equilibrium exists, the turbine operates at a constant and somewhat lower speed. As the load torque varies during the operation of the turbine, the governing system responds as described to maintain the balance of air flow 82 past the control valve 76 necessary to minimize the changes in turbine speed with load.

The pressure gas engine also includes an overspeed safety apparatus that not only interrupts the pressure gas flow into the turbine buckets during overspeed but also automatically moves and holds the rotor in contact with a braking means embodied in the braking pad or preferably pads 137. This braking apparatus operates as follows.

During normal operation of the turbine with the parts normally in the position of FIG. 1 before rotation begins and then in the position of FIG. 2 after rotation begins, the air flows to the nozzles 33 and from there through the buckets 41 on the rotor 26. However, if the speed control or any other portion of the apparatus malfunctions tending to increase the speed to dangerous levels, the centrifugally responsive balls 144 will move outwardly and forwardly on the inclined surfaces 146 of the pockets or recesses 145 in which they are located. This upward and outward movement as indicated by the arrow 167 in FIG. 2 causes the force of the balls to slide the rotor 26 against the force of retaining spring 140. When the balls 144 are at their maximum outward positions they have moved the rotor 26 so that the air 134 (FIG. 9) from the nozzles 33 cannot enter the buckets. The movement of the rotor 26 in this manner not only prevents the nozzle air 134 from entering the rotor buckets 41 but also permits this pressurized gas or in this embodiment air 134 to enter the large chamber 135 behind the rotor 26 on the side thereof opposite the friction surfaces 168 of friction brake pads 137. This then means that the full force and pressure of the gas 134 operates against the rotor to press the rotor against the pads 137 and provide an immediate stopping to the rotation of the rotor.

With the construction as disclosed in the specific embodiment of the drawings and described above the nozzle means 33 are supplied with pressurized gas from the gas supply passages 50, 66 and 81 leading to one side of the rotor 26 which is the bottom side as shown in FIGS. 1 and 2. The braking means embodied in the friction pads 127 ar located on the other or top side of the rotor 26, also as illustrated in these FIGURES. Then when the rotor has been moved to the second or upper position of FIG. 9 at excessive speeds substantially the entire force of the pressurized gas 134 as shown in this Figure is applied against this one or bottom side of the rotor 26. This gas pressure which in normal operation rotates the rotor thereby applies substantially its full force to the braking pads 137 to stop the rotor and prevent damage.

In order that this stopping of rotation will not be too abrupt which might tend to throw the illustrated grinding disc 64 from the shaft end 62, there is also provided the dish-shaped stop 141 which is contacted by the rotor before the rotor contacts the hosing adjacent surface 173. Before the rotor contacts this stop 141, it contacts the spring loaded friction pads 137 as described. This allows the springs 171 to apply a controlled normal force to the friction pads 137 causing a controlled frictional braking force to act on the rotor surface 136. Thus, the overspeed safety device brakes the rotor relatively gently to a complete stop so as to avoid damage.

In order to permit this axial movement of the rotor 26 relative to the axle 27, the rotor 26 is releasably connected to the axle 27 by way of the ring 147 through a plurality of connecting pins 153 of which there are three in number in the illustrated embodiment. These pins 153 each had a conical end 152 that are held in the similarly conical recesses 151 in the ring 147 during normal operation as is illustrated in FIGS. 1 and 2. However, during these excessive speeds and the axial movement of the rotor 26 to the fully braked position of FIG. 9, these conical ends 152 are almost completely removed from the recesses 151 (FIG. 9).

In order that the engine cannot again be operated until the malfunction condition is corrected, the balls 144 are then positioned between the ring 147 and the rotor body 26 as shown in FIG. 9 so that the rotor 26 cannot be moved back to operating position until the engine has been dismantled and the condition corrected at which time the balls 144 can be moved back to their normal position within the recesses 145 and essentially out of contact with the rotor 26.

We claim:

1. A pressure gas engine, comprising: a rotor having energy conversion means thereon for converting dynamic gas pressure to power; a drive axle; means for mounting said rotor on said axle for relative movement longitudinally of said axle; means interconnecting said rotor and drive axle for conjoint rotation; gas supply passage means to said engine adjacent one side of said rotor; gas exhaust passage means from said engine on the other side of said rotor; nozzle means in said supply passage for directing pressurized gas from said passage to said energy conversion means in one position of said rotor; means for moving said rotor to a second position at excessive speeds where said rotor energy conversion means are out of cooperative contact with said pressurized gas from said nozzle means; braking means on said other side of said rotor for retarding rotation of said rotor when out of said contact; and means for directing substantially the entire force of said pressurized gas from said nozzle means against said one side of said rotor for moving and holding said rotor against said braking means, the pressurized gas thereupon operating to rotate the rotor in one said longitudinal position of the rotor and for applying a braking force to the rotor in another said longitudinal position of the rotor.

2. A pressure gas engine, comprising: a rotor having energy conversion means thereon for converting dynamic gas pressure to power; a drive axle; means for mounting said rotor on said axle for relative movement longitudinally of said axle and for conjoint rotation; nozzle means for directing pressurized gas in streams to said energy conversion means in one position of said rotor; means for moving said rotor on said axle to a second position at excessive speeds where said rotor energy conversion means are out of cooperative engagement with said pressurized gas streams from said nozzle means, said means for moving said rotor to said second position comprising a collar member rotatable with said drive axle adjacent to said rotor when in said one position, a movable weight, and means mounting said weight for movement outwardly and toward said rotor for exerting pressure thereon and thereby moving said rotor energy conversion means out of said cooperative engagement; braking means for retarding rotation of said rotor, said means mounting said weight comprising means retaining the weight between the collar member and rotor to hold the rotor against said braking means; and means for subjecting a side means on said rotor to said pressurized gas for moving and holding said rotor against said braking means, the pressurized gas thereupon operating to rotate the rotor in one said longitudinal position of the rotor and for applying a braking force to the rotor in another said longitudinal position of the rotor.

3. The engine of claim 2 wherein there are provided gas supply passage means to said engine on one side of said rotor, gas exhaust passage means from said engine on the other side of said rotor, said holding means being located on said other side of said rotor, and said means for subjecting said pressurized gas to a side means on said rotor applies substantially the entire force of said pressuirzed gas againt said one side of said rotor.

4. The engine of claim 2 wherein said weight comprises a weighted ball and said retaining means on the base member comprises a pocket in which the ball is normally received and defined by an outer wall sloped radially and toward said rotor up which said ball moves under increasing rotational speeds to exert rotor moving leverage on said rotor at said excessive speeds.

5. The engine of claim 4 wherein said base member is provided with a ball receiving portion beyond said pocket with the ball being located between the rotor and this receiving portion as a result of said increasing rotational speeds.

* * * * *